US005936532A

United States Patent [19]

Peralta

[11] Patent Number: 5,936,532

[45] Date of Patent: Aug. 10, 1999

[54] SMOKE AND CARBON MONOXIDE DETECTOR WITH CLOCK

[76] Inventor: David A. Peralta, 10 Phyllis Pl., West Islip, N.Y. 11795

[21] Appl. No.: 09/102,834

[22] Filed: Jun. 16, 1998

[51] Int. Cl.[6] ..... G08B 17/00

[52] U.S. Cl. ..... 340/628; 340/693.5; 340/515

[58] Field of Search ..... 340/628, 629, 340/630, 693.5, 514, 515

[56] References Cited

U.S. PATENT DOCUMENTS

| | | | |
|---|---|---|---|
| D. 349,652 | 8/1994 | Grant, Jr. | D10/2 |
| 4,313,110 | 1/1982 | Subulak et al. | 340/628 |
| 4,611,200 | 9/1986 | Stilwell | 340/628 |
| 4,688,021 | 8/1987 | Buck et al. | 340/521 |
| 4,796,015 | 1/1989 | Admire, Jr. | 340/628 |
| 4,901,056 | 2/1990 | Bellavia et al. | 340/628 |
| 4,949,077 | 8/1990 | Mbuthia | 340/628 |
| 5,289,165 | 2/1994 | Belin | 340/628 |
| 5,594,422 | 1/1997 | Huey, Jr. et al. | 340/628 |

*Primary Examiner*—Jeffery A. Hofsass
*Assistant Examiner*—Julie B. Lieu
*Attorney, Agent, or Firm*—Goldstein & Canino

[57] ABSTRACT

A smoke and carbon monoxide detector for mounting upon a wall, having a housing having a front face. A clock having clock hands and clock indicia is present on the front face. The detector comprises a smoke detector element, a carbon monoxide detector element, and has an annunciator which sounds upon the presence of smoke or carbon monoxide. A deactivation button allows the annunciator to be temporarily deactivated in the event of a clearly false warning. The deactivation button also initiates a timing operation so that the annunciator is automatically re-enabled at the end of a predetermined time interval.

3 Claims, 2 Drawing Sheets

SMOKE AND CARBON MONOXIDE DETECTOR WITH CLOCK

BACKGROUND OF THE INVENTION

The invention relates to a smoke and carbon monoxide detector. More particularly, the invention relates to a wall clock having a smoke and carbon monoxide detector incorporated therein, which is selectively deactivated but which automatically reactivates after a predetermined time period.

Over the last two decades, smoke detectors have become universally present in residential and commercial structures. A smoke detector can warn of a smoldering fire before any significant property damage occurs, and before the occupants of the structure find themselves in grave danger. Thus by and large, the presence of smoke detectors in new and existing structures is now required by law. This trend has clearly saved countless lives and prevented untold billions in property damage.

Generally smoke detectors are mounted in several locations throughout the home. The rule of thumb is that a smoke detector should at least be mounted on every floor of a structure. Although it is desirable to mount a smoke detector somewhat near the ceiling, this makes it difficult to access the smoke detector to either change the battery or to stop the alarm from sounding when it is clearly because of cooking smoke. Thus, it is often desirable to mount the detector at a lower, more accessible location. However, mounting a smoke detector at a lower location on a wall can be unsightly, and is thus undesirable.

In addition, when conventional smoke detectors are clearly sounding because of a false triggering, the solution is often to remove the battery or take other steps to deactivate the smoke detector. However, once the smoke detector is deactivated, the user often forgets to reactivate the smoke detector. Thus, the safety of the building structure and its occupants is compromised until someone notices that the smoke detector has been disabled.

Recently, carbon monoxide detectors have also become widely available. That is, carbon monoxide detection technology has advanced to allow these devices to be inexpensively available, and the public has followed suit by purchasing them for their homes and businesses.

Carbon monoxide is an odorless, colorless gas which is extremely poisonous to humans and animals. When air containing carbon monoxide is inhaled, it is absorbed by blood cells as if it were oxygen. However, not only does this starve the body of oxygen, but the poisoning progresses rapidly, since once carbon monoxide is absorbed by the blood cells, it is not easily released therefrom.

Unfortunately, carbon monoxide is produced by the burning of many different fuels that occurs daily within or near structures. Thus, the modern trends have been for building owners and apartment dwellers to install carbon monoxide detectors, and for governmental agencies to being to universally mandate these devices for all structures.

U.S. Pat. Nos. 4,796,015 to Admire, Jr.; 4,611,200 to Stilwell; 4,949,077 to Mbuthia; and Des. 349,652 to Grant, Jr. each disclose different smoke alarms which are combined with a clock.

While these units may be suitable for the particular purpose employed, or for general use, they would not be as suitable for the purposes of the present invention as disclosed hereafter.

SUMMARY OF THE INVENTION

It is an object of the invention to produce a smoke and carbon monoxide detector which is readily accessible.

Accordingly the smoke and carbon monoxide detector is mounted upon a wall at a height where it is easily accessible.

It is another object of the invention to provide a smoke and carbon monoxide detector which is unobtrusive in any decor. Accordingly, the smoke and carbon monoxide detector is incorporated within a wall clock.

It is a further object of the invention to provide a smoke and carbon monoxide detector which is easily deactivated upon a false triggering, such as when triggered by cooking smoke. Accordingly, a deactivation button is provided to easily deactivate the smoke detector.

It is a still further object of the invention to provide a smoke detector which automatically reactivates after it is manually deactivated. Accordingly, following a predetermined period after the smoke detector is manually deactivated, the smoke detector is automatically reactivated.

It is yet a further object of the invention to that the predetermined period is approximately one half hour, so that the smoke detector allows cooking tasks to be completed, and then reactivates at a time when cooking has most likely been completed.

The invention is a smoke and carbon monoxide detector for mounting upon a wall, having a housing having a front face. A clock having clock hands and clock indicia is present on the front face. The detector comprises a smoke detector element, a carbon monoxide detector element, and has an annunciator which sounds upon the presence of smoke or carbon monoxide. A deactivation button allows the annunciator to be temporarily deactivated in the event of a clearly false warning. The deactivation button also initiates a timing operation so that the annunciator is automatically re-enabled at the end of a predetermined time interval.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
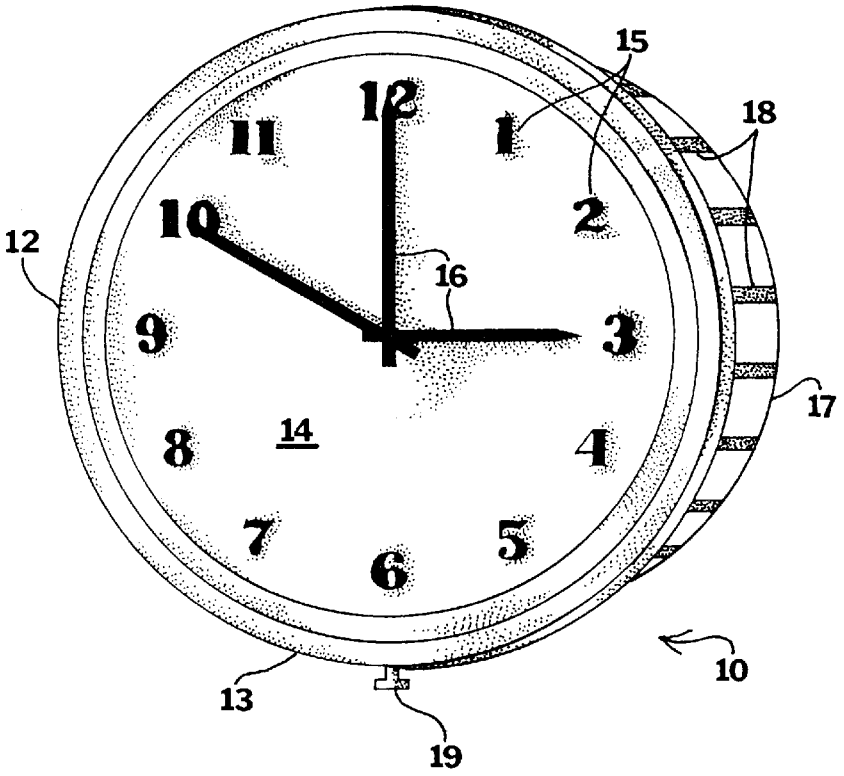
FIG. 1 is a diagrammatic perspective view, illustrating the smoke and carbon monoxide detector system, incorporated within a wall clock.

FIG. 1 illustrates a detector system 10, comprising a housing 12 having a bottom 13 and a front 14. A clock 14 is present at the front 14, comprising numbered indicia 15 and clock hands 16. The clock is preferably a standard wall clock, wherein one of the clock hands 16 makes one rotation every hour and the other every twelve hours.

The housing 12 has a periphery 17 which has a plurality of vents 18 for allowing air around the housing 12 to enter said housing 12. A deactivation button 19 is located at the bottom 13 of the housing 12. The function of said deactivation button 19 will be described below.

Figure 3:
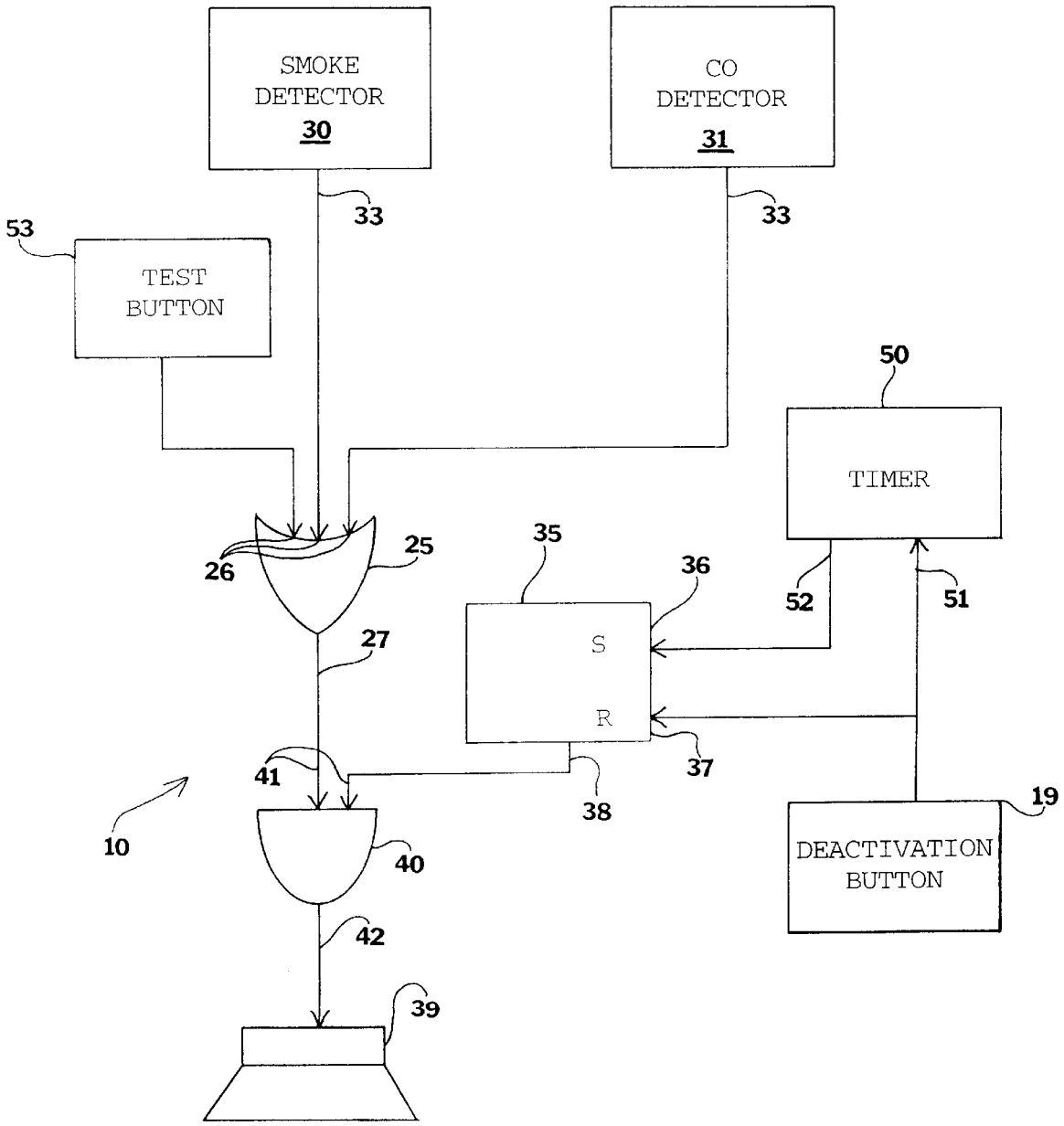
FIG. 3 is a block diagram, illustrating the major functional components of the clock.

FIG. 3 is a block diagram, illustrating the functional components of the smoke detector system 10. The smoke detector system 10 includes a smoke detector element 30 and a carbon monoxide detector element 31. The smoke detector element 30 may employ ionization, photoelectric, or any other detection technique. The smoke detector element 30 and carbon monoxide detector element 31 each produce an enabling output 33 upon the presence of smoke or carbon monoxide, respectively.

An OR gate 25 is provided, having two or more inputs 26 and an OR gate output 27. The enabling outputs 33 from the smoke detector element 30 and the carbon monoxide detector element are both connected to the OR gate inputs 26 so that the OR gate output 27 is enabled whenever either the smoke detector element 30 and carbon monoxide detector element produces an enabling output.

An S-R latch 35 has a setting input 36 and a reset input 37 for selectively setting and resetting said latch 35. The latch produces a latch output 38 which is enabled when the latch is set, and disabled when the latch is reset.

An AND gate 40 is provided having a pair of AND gate inputs 41 and an AND gate output 42. The latch output 38 is connected to one of the AND gate inputs 41. The OR gate output 27 is connected to the other OR gate input 41. The AND gate output 42 is connected to an annunciator 39, which thus produces a loud warning sound when simultaneously enabled by the latch output 38 and the OR gate outputs 42. Thus, upon the presence of smoke or carbon monoxide, and when the latch 35 is set, the annunciator 39 produces a loud warning sound.

The latch 35 is normally set. However, the latch is selectively manually reset by the deactivation button 19 that is connected to the reset input 37. Thus, once the deactivation button 19 is pressed, the annunciator 39 will cease sounding the warning.

A timer 50, having a timer input 51 and a timer output 52, is provided to time a predetermined timing interval. The deactivation button 19 is connected to the timer input 51 to initiate the timing operation. The timer output 52 is connected to the set input 36 to set the latch 35 once the timing interval has been completed. This predetermined timing interval is preferably approximately one half hour. At the completion of the timing interval, the latch 35 is once again set, and thus the annunciator 39 can sound a warning. The timer 50 may actually be integral with the clock, such that the clock provides the timing function as indicated. This provides a further logical connection and synergy for providing a clock that is combined with smoke and carbon monoxide detectors.

Preferably a test button 53 is provided and is connected to one of the OR gate inputs 26. Thus, the OR gate 25 illustrated in FIG. 3 has three inputs 26. If the latch is set, then pressing the test button 53 will cause the annunciator to sound. Thus, the test button 53 will allow a user to ascertain if the detector 10 is functioning and ready to produce a warning sound if smoke or carbon monoxide were to be detected.

Figure 2:
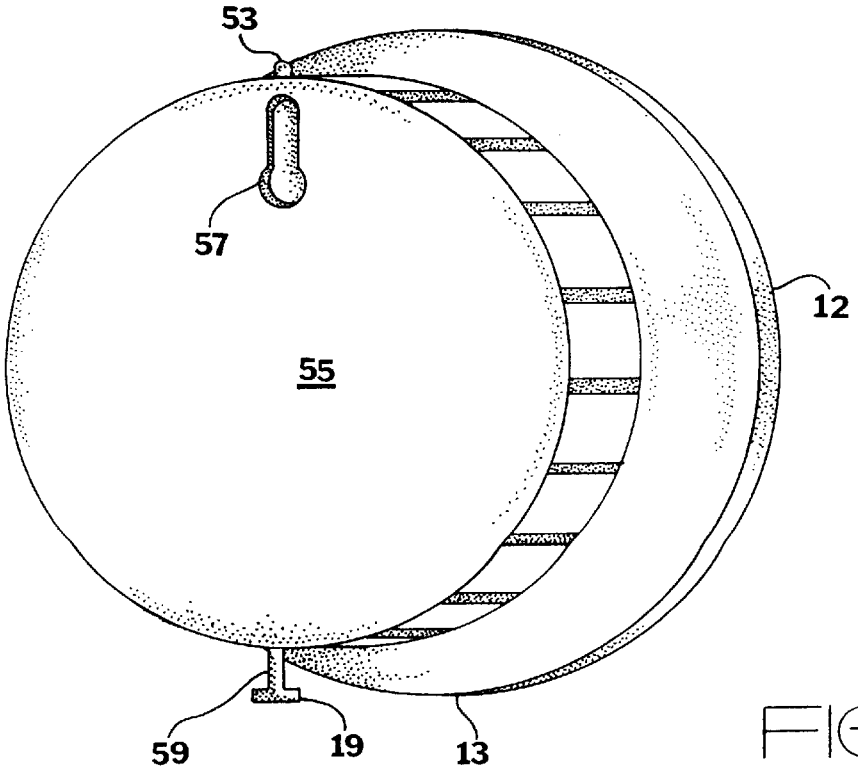
FIG. 2 is a rear perspective view thereof, illustrating the manual deactivation button.

FIG. 2 is a rear perspective view, illustrating that the housing 12 has a housing rear 55 which has a mounting hole 57 for mounting upon a wall. Further illustrated is the deactivation button 19 at the bottom 13 of the housing. The deactivation button 19 has a stem 59 to extend said button so that it is easily operated when desired. The test button 53 may be provided in a slightly less accessible location, atop the housing 12, since it is less frequently used.

The operation of the detector 10 is summarized as follows. Upon the presence of smoke and/or carbon monoxide, the annunciator will sound as long as the latch is set. The latch is normally set, but is resetable by pressing the deactivation button. Once the deactivation button is pressed, the timing interval is initiated. The latch will remain reset until the timing interval is completed, at which point the timer once again set the latch. Once the latch is set, the annunciator may sound upon the presence of smoke and/or carbon monoxide. A test button will cause the annunciator to sound if the latch is set and the detector is thus enabled.

In conclusion, herein is presented a detector system which combines smoke and carbon monoxide detection within a standard wall clock housing. A deactivation button is provided to deactivate the annunciator for a predetermined time interval, at which time the annunciator is automatically reactivated.

What is claimed is:

1. A detector, for attaching onto a wall, comprising:

a housing having a front, a bottom, and a rear, the rear is mounted to the wall, the housing having vents for allowing air outside the housing to enter the housing;

a clock, mounted on the front;

a smoke detector for producing an enabling signal in response to the presence of smoke;

an annunicator for producing a warning sound upon the presence of the enabling signal from the smoke detector;

a deactivation button, for temporarily disabling the annunciator, that deactivates the annunciator for a predetermined time interval and then automatically re-enables the annunciator;

the latch, reset by the deactivation button, has a latch output which is enabled when the latch is set, and further comprises an AND gate having AND gate inputs and an AND gate output, the annunciator is connected to the AND gate output, the smoke detector and the latch are connected to the AND gate inputs so that the annunciator will sound when both the latch output is enabled and the smoke detector enabling signal is enabled; and the timer is enabled by the deactivation button and begins timing when enabled therefrom, the timer sets the latch after the predetermined interval has been timed.

2. The detector as recited in claim 1, further comprising a carbon monoxide detector which also produces an enabling output, an OR gate having OR gate inputs and an OR gate output, the carbon monoxide detector and smoke detector enabling outputs are connected to the OR gate inputs, the OR gate output is connected to the AND gate input along with the latch output.

3. The detector as recited in claim 2, wherein the OR gate is a three input OR gate, and further comprising a test button, the test button connected to one of the OR gate inputs so that the test button can be activated to sound the annunciator to determine is the latch is set.

* * * * *